US008165461B2

(12) United States Patent
Sullivan

(10) Patent No.: US 8,165,461 B2
(45) Date of Patent: Apr. 24, 2012

(54) MODULAR HEATING SYSTEM FOR TANKLESS WATER HEATER

(76) Inventor: Joseph M. Sullivan, Gilbert, AZ (US)

( * ) Notice: Subject to any disclaimer, the term of this patent is extended or adjusted under 35 U.S.C. 154(b) by 936 days.

(21) Appl. No.: 12/151,675

(22) Filed: May 7, 2008

(65) Prior Publication Data

US 2008/0285964 A1 Nov. 20, 2008

Related U.S. Application Data

(60) Provisional application No. 60/916,490, filed on May 7, 2007.

(51) Int. Cl.
*F24H 1/10* (2006.01)

(52) U.S. Cl. ..... 392/485; 392/465; 392/494

(58) Field of Classification Search ..... 392/465–491
See application file for complete search history.

(56) References Cited

U.S. PATENT DOCUMENTS

| | | | | | |
|---|---|---|---|---|---|
| 877,183 | A * | 1/1908 | Elkins | 392/491 |
| 1,098,573 | A * | 6/1914 | Hauser, Jr. | 392/491 |
| 2,663,787 | A * | 12/1953 | Alexander | 392/471 |
| 2,775,683 | A * | 12/1956 | Kleist | 392/398 |
| 3,498,279 | A * | 3/1970 | Seeley, Jr. | 123/549 |
| 3,835,294 | A * | 9/1974 | Krohn et al. | 392/484 |
| 3,846,616 | A * | 11/1974 | Beck | 392/487 |
| 3,968,346 | A * | 7/1976 | Cooksley | 392/491 |
| 4,436,983 | A * | 3/1984 | Solobay | 392/490 |
| 4,550,710 | A * | 11/1985 | McDonald, II | 122/13.01 |
| 4,567,350 | A * | 1/1986 | Todd, Jr. | 392/486 |
| 4,692,592 | A * | 9/1987 | Kale | 392/450 |
| 4,808,793 | A * | 2/1989 | Hurko | 392/489 |
| 4,823,767 | A * | 4/1989 | Wust | 126/20 |
| 5,216,743 | A | 6/1993 | Seitz | |
| 5,325,822 | A * | 7/1994 | Fernandez | 392/491 |
| 5,408,578 | A * | 4/1995 | Bolivar | 392/490 |
| 5,866,880 | A | 2/1999 | Seitz et al. | |
| 6,080,971 | A | 6/2000 | Seitz et al. | |
| 6,175,689 | B1 * | 1/2001 | Blanco, Jr. | 392/485 |
| 6,246,831 | B1 | 6/2001 | Seitz et al. | |
| 6,389,226 | B1 * | 5/2002 | Neale et al. | 392/485 |
| 6,701,069 | B1 * | 3/2004 | Cezayirli et al. | 392/490 |
| 6,806,446 | B1 * | 10/2004 | Neale | 219/497 |
| 6,909,843 | B1 * | 6/2005 | Fabrizio | 392/490 |
| 7,039,305 | B1 * | 5/2006 | Chen | 392/490 |
| 7,046,922 | B1 | 5/2006 | Sturm et al. | |
| 7,088,915 | B1 | 8/2006 | Sturm et al. | |
| 7,460,769 | B2 * | 12/2008 | Ryks | 392/490 |
| 7,567,751 | B2 * | 7/2009 | Fabrizio | 392/490 |
| 7,779,790 | B2 * | 8/2010 | Fabrizio | 122/40 |
| 2001/0004009 | A1 * | 6/2001 | MacKelvie | 165/47 |

* cited by examiner

*Primary Examiner* — Thor Campbell
(74) *Attorney, Agent, or Firm* — Parsons & Goltry; Robert A. Parsons; Michael W. Goltry

(57) ABSTRACT

There is provided a tankless water heater for heating water passing therethrough. The modular heater comprises a plurality of heating units, each heating unit comprising a heating tube and a coupler, wherein each heating tube defines an interior region and each heating tube includes a helical structure whereby the helical structure imparts a swirling motion on water passing through the interior region of the tube. A heating element is also disposed within the interior region of the heating tube, and electric power applied to the heating element acts to heat the water passing through the tube. Temperature sensors may be positioned so as to detect water temperature proximate the inlet portion, and the outlet portion. Additionally, a flow meter is positioned proximate the inlet portion. The controller directs signals to switches positioned at each tube so as to apply electric current to the heating elements.

7 Claims, 6 Drawing Sheets

MODULAR HEATING SYSTEM FOR TANKLESS WATER HEATER

CROSS REFERENCE TO RELATED APPLICATIONS

This application claims priority from the provisional patent application Ser. No. 60/916,490 filed May 7, 2007 in the name of Joseph M. Sullivan entitled "Modular Heating System for Tankless Water Heater," incorporated herein by reference.

FIELD OF THE INVENTION

The present invention relates to a tankless hot water heater. More particularly the present invention relates to a tankless hot water heater having a modular heating system and methods for using the tankless hot water heater.

BACKGROUND OF THE INVENTION

Hot water heaters are known in the art and exist in various forms. Generally, a water heater consists of a water tank and a mechanism for heating the water within the tank. Various problems are associated with such standard water heaters. One such problem is that the water must always be available to the user. Thus, the water must remain constantly heated even when not in use. This is grossly inefficient as a considerable amount of energy must be consumed to constantly heat the water. Another problem is a large amount of water must remain in the tank at all times. However, when water sits for an extended period of time, deposits from the water begin to settle at the bottom of the tank. Over time the deposits can cause the tank to structurally fail thereby causing unwanted water leakage. Another problem with conventional water heaters deals with sizing concerns. Standard water heaters are sized in accordance with the amount of hot water that will be consumed on a daily basis. However, if at some point the amount of water to be consumed increases, the owner of the water heater has two unpleasant choices. On the one hand he may purchase a larger water heater so as to meet the increased demand. Alternatively, the owner/user can opt to go without hot water for a period of time while the smaller hot water heater reheats the new water that replaced the depleted water. Further, if the amount of water consumed in a household decreases, then the larger water heater remains a cost burden for the user in that the excess water in the tank must still be constantly heated.

Accordingly, it would be desirable to design and manufacture a hot water heater that is efficient, alleviates the concerns for failure, and is easily modifiable for increased or decreased water consumption. It would further be desired to design and develop such an improved hot water heater that can be easily retrofit into existing plumbing equipment and layouts. It would further be desired to develop a hot water heater that is robust and has a good service life. Finally, it would also be desired to develop a hot water heater that is generally inexpensive to build. The present invention addresses one or more of these needs.

SUMMARY OF THE INVENTION

In accordance with one aspect of the present invention, and by way of example only, there is provided a tankless water heater for heating water passing therethrough. The tankless water heater includes a control module with a controller and a heating system, each of which are configured in a modular/separate arrangement. The heating system includes an inlet portion, an outlet portion, and a modular heater interconnected therebetween. The modular heater comprises a plurality of heating units, each heating unit comprising a heating tube and a coupler, wherein each heating tube defines an interior region and each heating tube includes a helical structure whereby the helical structure imparts a swirling motion on water passing through the interior region of the tube. A heating element is also disposed within the interior region of the heating tube, and electric power applied to the heating element acts to heat the water passing through the tube. A first temperature sensor may be positioned so as to detect water temperature proximate the inlet portion, and the first temperature sensor is in communication with the controller. Also, a second temperature sensor positioned so as to detect water temperature proximate the outlet portion, and the second temperature sensor is in communication with the controller. Additionally, a flow meter is positioned proximate the inlet portion, and the flow meter, which detects fluid flow (and thereby fluid volume), is in communication with the controller. The controller, receiving the signals from the temperature sensors and the flow meter directs signals to switches positioned at each tube so as to apply a proportional amount of electric current to the heating elements.

In another aspect of the present invention, still by way of example only, there is provided a tankless water heater configured such that the control module and high voltage components are positioned above the heating system as in separate modules. Additionally, a dividing wall may separate the control module from the heating system such that leaks or malfunctions in the heating system unit, already positioned below the control unit, do not contaminate or harm the control module. A transformer, which receives input power to the water heater and converts that electric power to a level and signal desired for internal function, may also be positioned above the heating system in the control module for similar protection. It is also noted that the heating system is configured such that water flows therethrough in a generally downward direction; i.e., the inlet is positioned above the outlet, and the flow through each successive heating tube is in a generally downward direction. This configuration aids with draining and the purging of contaminants within the system.

In further exemplary aspects of the tankless water heater it is noted that individual heating tubes are connected to the coupler by an o-ring coupling. The heating tube itself may be comprised of stainless steel. The heating tube may be substantially enclosed in an insulator. Further, the heating tube may preferably be of a substantially circular cross section.

In a further aspect of the present invention, still by way of example only, it is noted that each individual heating tube may include a helical structure for imparting a movement on the water that passes through the tube. The movement imparted on the water may be characterized as a vortex or cyclonic. The helical structure of the heating tube comprises a groove extending into the interior region of the heating tube. The groove or grooves having the helical shape may give a heating tube an outward appearance akin to a candy cane type of candy insofar as the groove makes spirals around the tube while traversing from a first end of the tube to the opposite end. Alternatively, the helical structure may be a separate structure.

Other independent features and advantages of the modular heating system will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

Figure 1:
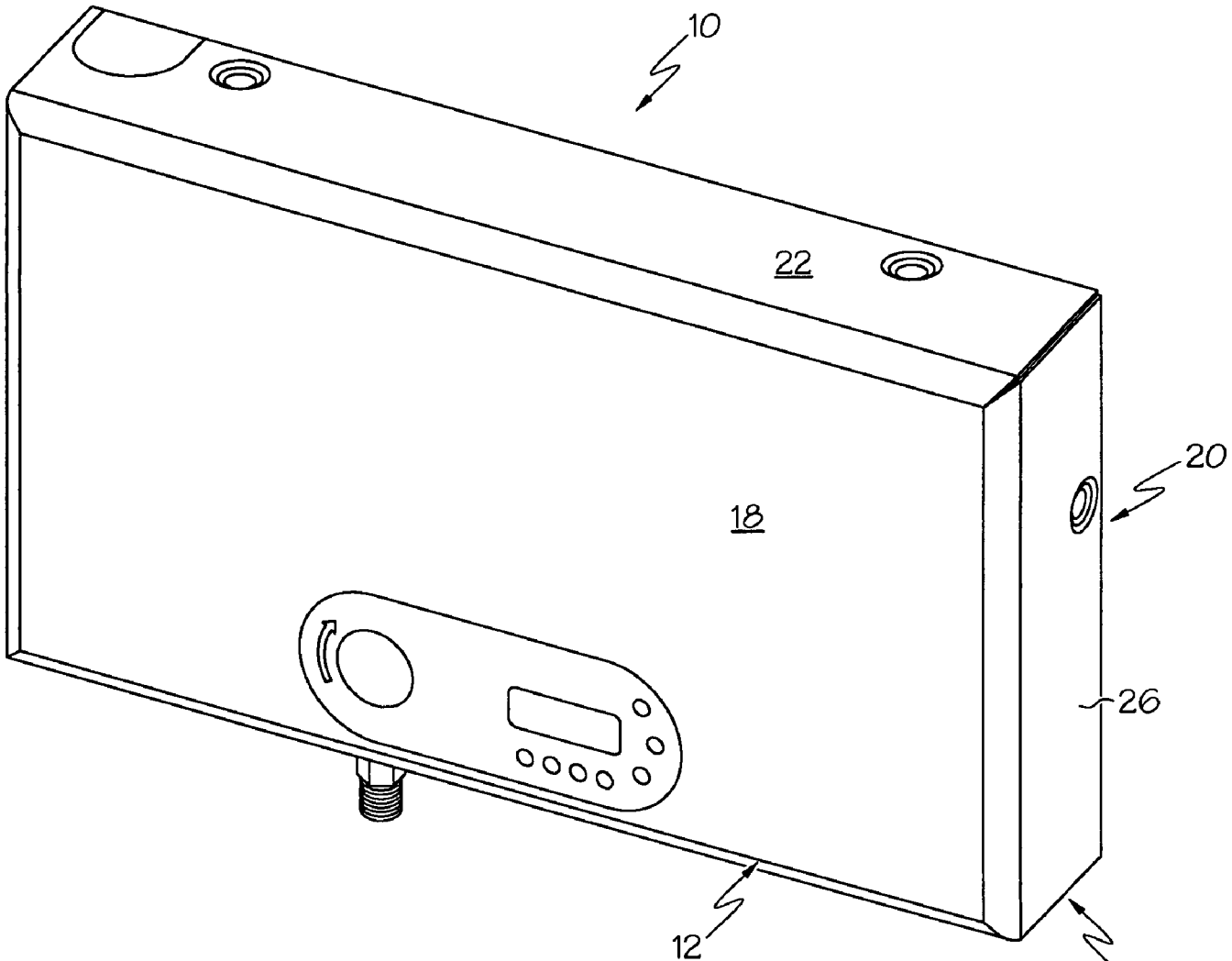
FIG. 1 is a perspective view of a modular water heater according to an embodiment of the present invention.
Figure 2:
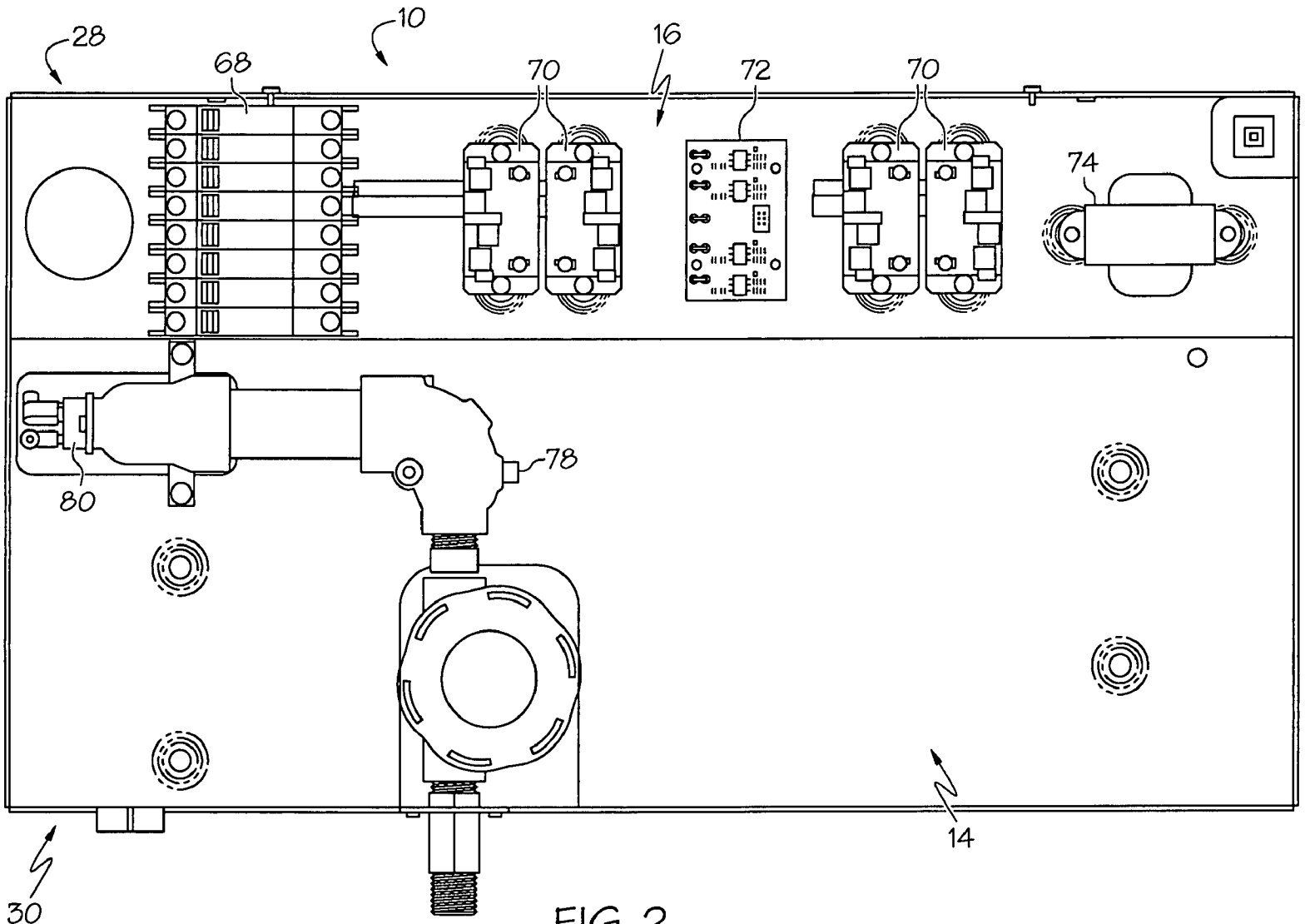
FIG. 2 is a front view of the water heater with a portion of the housing removed so that an internal portion may be viewed.

Referring initially to FIGS. 1 and 2, a water heater 10 of the present invention is shown. The water heater 10 generally includes a housing 12 that encloses a heating system 14 and a control system 16. The housing 12 includes front 18, rear 20, top 22, bottom 24, and side 26 portions.

In a preferred embodiment housing 12 contains an upper sub assembly 28 and a lower sub assembly 30. The upper sub assembly houses the control system 16 while the lower sub assembly 30 houses the heating system 14. It has been found advantageous to divide the upper sub assembly 28 and the lower sub assembly 30. Advantages of the modular design include a decreased likelihood of contamination or leakage originating from the heating system 14 and directed toward the control system 16. By positioning the upper sub assembly 28 in a general position above the lower sub assembly 30, gravity tends to draw any unexpected leakage or contamination from the heating system 14 in a downward direction away from the direction of the upper sub assembly 28. Further, in a preferred embodiment a partition or wall may be positioned between the upper sub assembly 28 and the lower sub assembly 30 so as to isolate one from the other. In accordance with an exemplary embodiment of the present invention, the housing 12 has a wider than tall aspect ratio.

Figure 3:
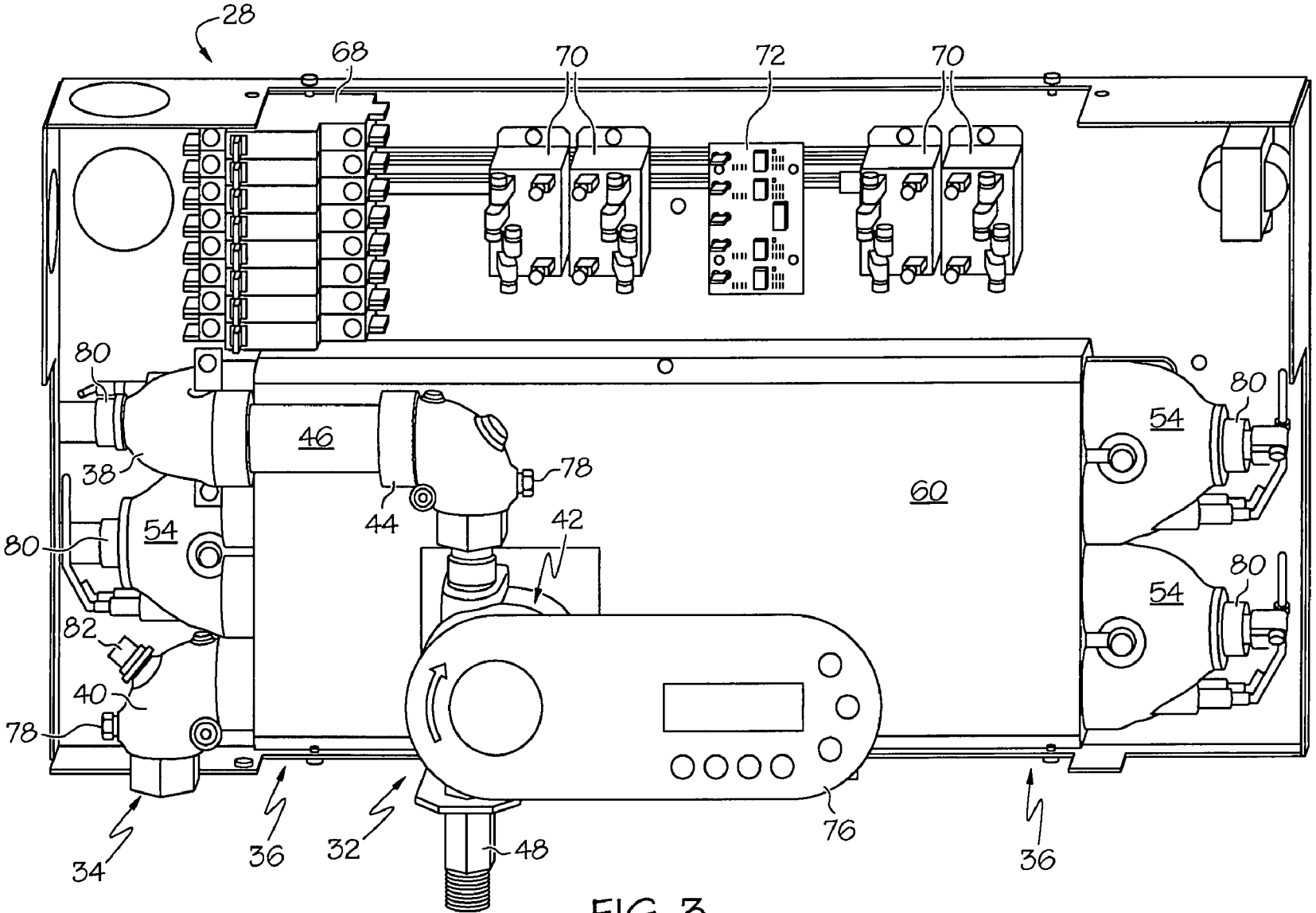
FIG. 3 is a further perspective view similar to FIG. 1 but with a portion of the housing removed so that an internal portion may be viewed.
Figure 4:
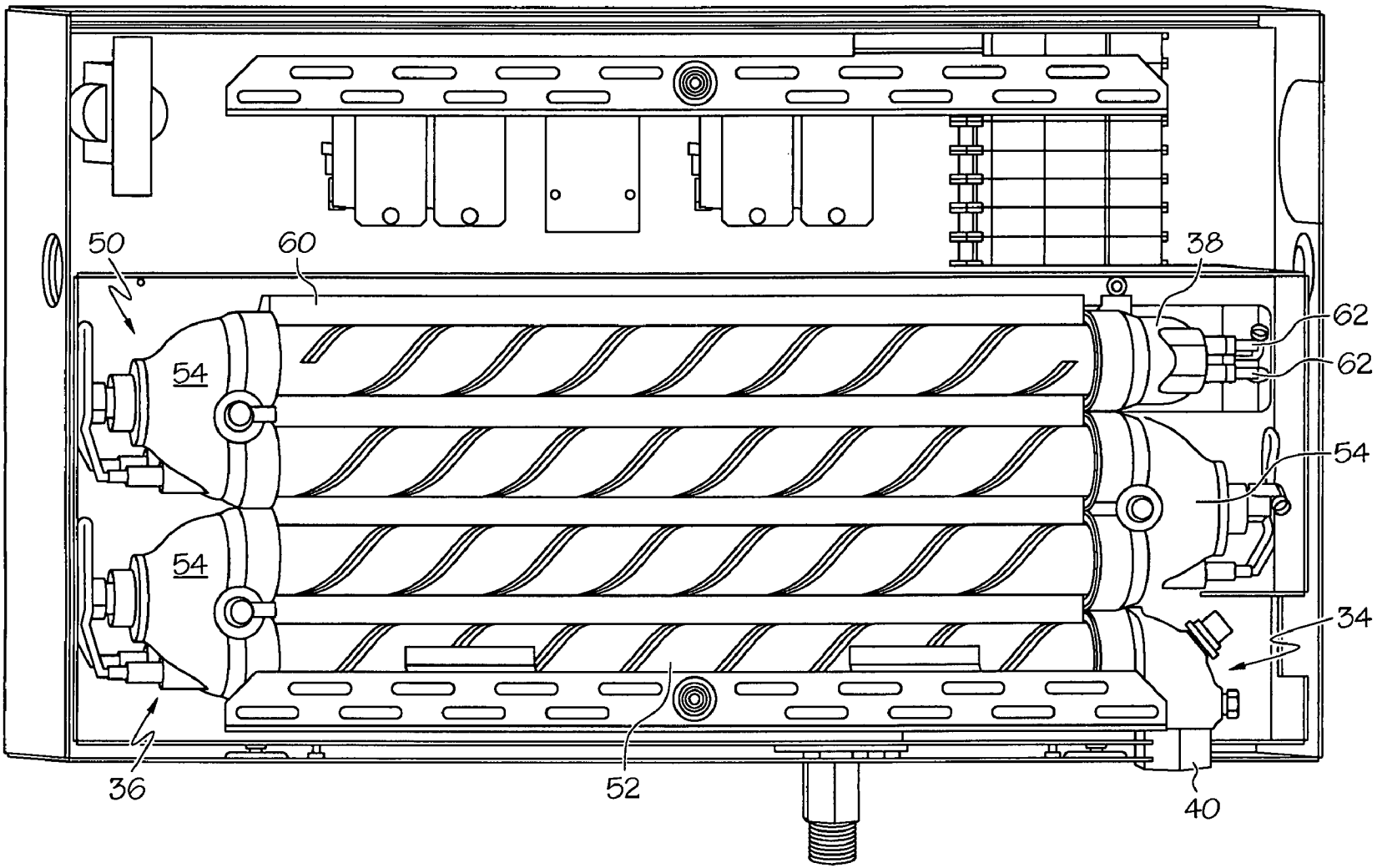
FIG. 4 is a rear view of the water heater with a portion of the housing removed so that the heating system may be viewed.
Figure 5:
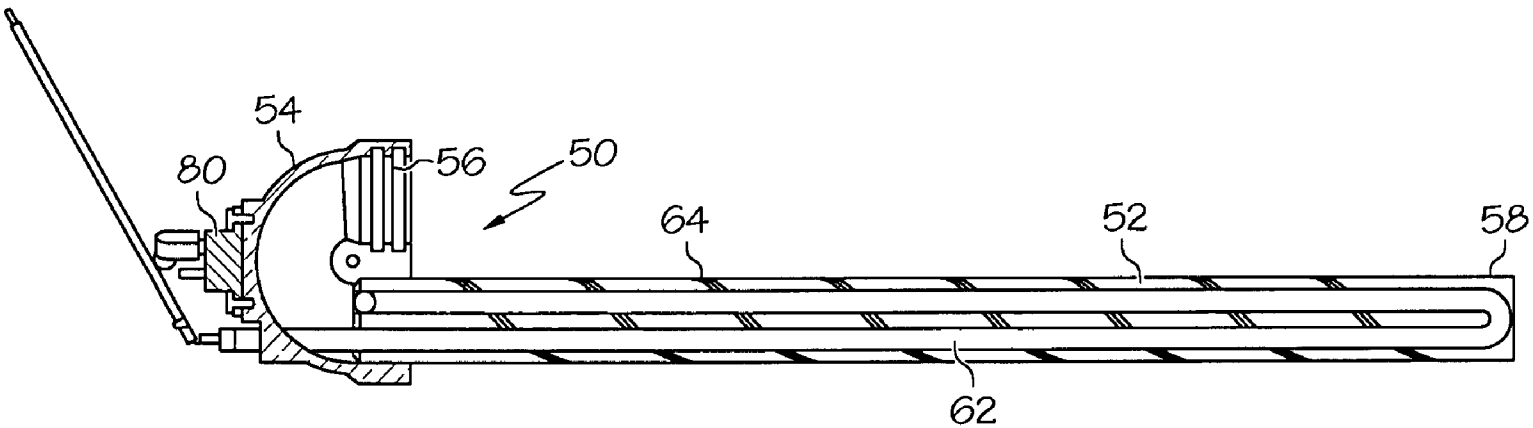
FIGS. 5-8 are further views of a heating unit according to an embodiment of the present invention.
Figure 6:
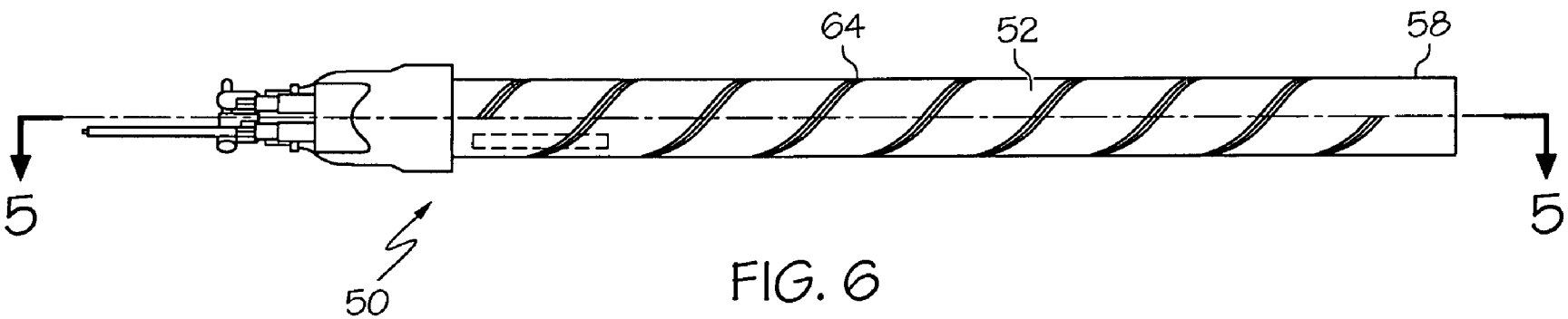
Figure 7:
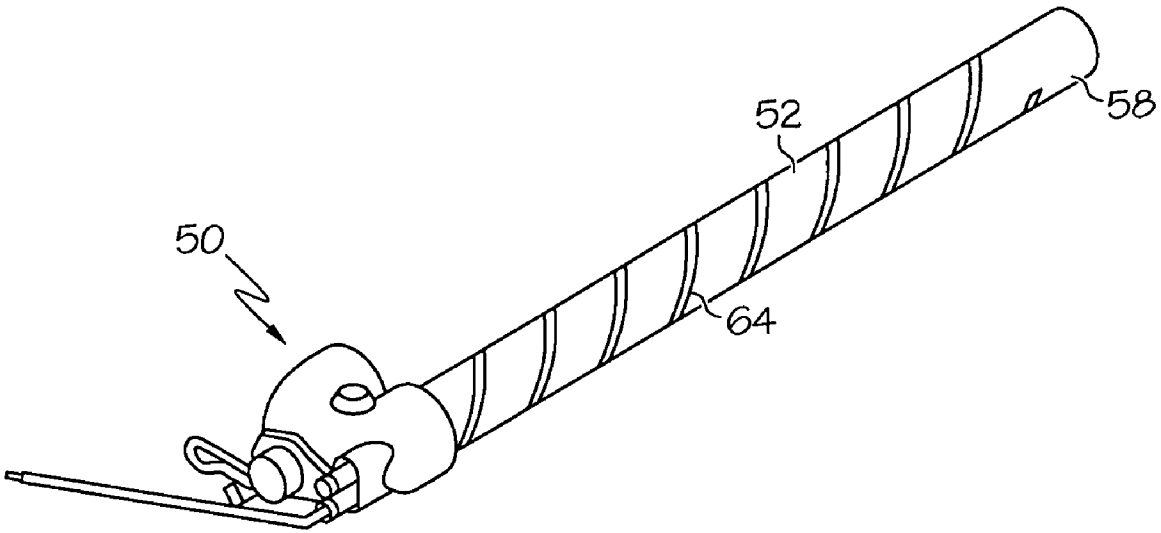
Figure 8:
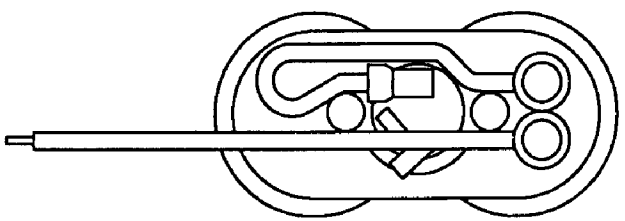

Referring now to FIG. 3, the heating system 14 will be discussed in greater detail. Heating system 14 includes an inlet portion 32, an outlet portion 34, and a modular heater 36 interconnected therebetween. It should be understood that the water enters through the inlet portion 32, flows through the modular heater 36, and exits via the outlet portion 34. The inlet and outlet portions 32 and 34 are connected to the heater 36 by first and second connectors 38, 40.

Still referring to FIG. 3, a preferred embodiment of the inlet portion 32 contains a flow meter 42, an interface fitting 44, and a tube 46. The flow meter 42 is coupled with the water supply via an inlet connector 48, and the flow meter 42 monitors the flow rate of water at the inlet 32. The tube 46 is coupled with the first connector 38 of the heating system 14 while the interface fitting couples the flow meter 42 with the tube 46. The outlet portion 34 is coupled with the second connector 40 of the heating system 14.

Referring now to FIGS. 4-8, the modular heater 36 will be discussed. The modular heater 36 includes a plurality of heating units 50. Each heating unit 50 contains a heating tube 52 and a coupler 54. The coupler 54 contains a connection portion 56 that receives an end 58 of the heating tube 52 such that multiple heating units can be used in a heating system 14. It should be understood that any suitable coupling method may be used, including but not limited to an o-ring coupler or a threaded coupling arrangement. In an exemplary embodiment the fittings between the connection portion 56 and the end 58 of the heating tube 52 are based off standard pipe fittings known to one of ordinary skill in the art. Further, the inlet and outlet portions 32, 34 that interface with the household plumbing are based off standard pipe fittings known to one of ordinary skill in the art.

The heating tubes 52 are preferably made from stainless steel although any suitable material may be used. The number of heating tubes 52 can vary depending on factors such as the amount of water that is needed to be heated and the temperature to which it is to be heated, and the rate at which it is to be heated. A greater number of heating tubes 52 corresponds to an ability to heat water at an increased flow rate. The heating tubes 52 may be enclosed in an insulator 60. The insulator 60 is constructed, in a preferred embodiment, from foam, although any suitable material may be used. Each of the heating tubes 52 may be cylindrical and may be configured to have an elongated heating element 62 disposed therein along its length.

The heating tube 52 may further be configured with a helix structure 64 generally disposed along its length. The helix 64 may serve to provide an internal turbulator within the heating tube 52 to cause the flow to follow a vortex pattern as the water flows therethrough. As such, the water enters through the inlet portion 32 at a first temperature, flows through the heating tubes 52, is heated by the heating element 62, and exits from the outlet portion 34 at a high temperature. In a preferred embodiment, helix structure 64 is comprised of a groove or set of grooves formed or impressed on heating tube 52. In an alternative embodiment, helix structure 64 comprises a separate structure that is fitted within a heating tube 52. It is noted that the helix structure 64 preferably includes ridges or protuberances that protrude within the interior area of the heating tube 52. Thus, as water flows through heating tube 52, water that is in contact with the helix structure 64 will tend to follow the helical pattern of the helix structure 64. Thus a vortex or swirling motion is imparted into the water flow.

It is to be appreciated that the cyclonic flow of water through heating tube 52 imparts several advantages. A first advantage is an improved heating efficiency. A cyclonic pattern of water flow brings a greater volume of water into contact with heating element 62 than would occur in laminar flow; and thus the cyclonic flow pattern allows for improved heat transfer. The cyclonic water pattern also improves the overall function of the water heater in suspending, carrying, and removing impurities and particulates from the heating unit. As is known in the heating art, solids and scale can build up on surfaces exposed to water especially when the water is a hard water that includes minerals. These particulates can occasionally flake off which can be a source of reduced water flow, leaks, and generally poor function. The cyclonic flow helps to ameliorate this tendency by providing a motion within the water flow that tends to suspend and carry the impurities out of the system. In this regard it is further noted that the water flow through the heating system is generally designed to progress and flow in a downward direction such that gravity, acting in concert with the cyclonic flow, also tends to pull the impurities out of the system. Thus the horizontal orientation of the heating tubes 52 and the top to bottom flow arrangement of the multiple heating tubes 52 provides for a self flushing system. Also, the heating tube configuration is such that when the flow of water stops and the system is not in use, the water in the tubes can drain from the tubes. Thus in one embodiment, water is not stored in the tubes. However, in an alternative embodiment back pressure can maintain water in the tubes if desired. In those embodiments where the water drains from the tubes when not in use, the design allows debris to exit the system when not in use.

In a preferred embodiment, a helical structure for imparting a cyclonic or vortex-type movement in the water as it passes through the hollow tube is a continuous helical groove formed in the tube so as to extend to an interior region of the tube. Alternatively, a separate structure such as, for example, a spring may be slid into the hollow interior region of a tube so as to form a helical structure which imparts a similar motion in the water. It is noted that the helical structures need not define continuous curves, they may have discontinuities. Alternatively other structures such as structures akin to turbine blades may be used to impart motion in the water. Still also, structures such as ridges, bumps and indentations may be used. The pattern of the structures preferably imparts a cyclonic motion. However, it is also within the scope of the invention to have structures positioned such that they impart a random motion or turbulent flow in the water.

In accordance with another exemplary embodiment the water heater 10 is configured so as to be a tankless water heater. Tankless means that the water heater contains only pipes or tubes but no portions configured to collect and store water that are enlarged greater than the remainder of the system. The system does not include an accumulation chamber.

In a preferred embodiment, the heating units 50 are interconnected so as to form the modular heater 36. Specifically the upper heating tube 52 of the heating unit 50 is received in the first connector 38, and the first connect 38 is coupled with the inlet portion 32. The next heating tube 52 is received in the connection portion 56 of the coupler 54 of the upper heating unit 50. The next heating tube 52 is received in the connection portion 56 of the coupler 54 of the previous heating unit 50. It should be understood that any number of heating units may be added to this configuration based upon an increase in the amount of water to be supplied. The lower heating tube 52 is received in the connection portion 56 of the coupler 54 of the previous heating unit. The second connector 40 is then connected to the end of the lower heating tube 52. The second connector 40 is connected to a water outlet.

Referring again to FIGS. 2 and 3, the control system 16 will be discussed. Control system 16 may be configured to measure the incoming temperature and flow rate of the water. The control system 16 may also measure the output temperature of the water. The control system 16 can then adjust the amount of current, power, or electricity supplied to the heating elements 62 within the tube 52 so as to either raise or lower the output temperature of the water. It will be understood by those skilled in the art that heating is achieved by supplying power in the form of an electric current to a resistor-type heating element 62 which acts to heat up the element 62 and then also to heat up the surrounding water flowing around the heating element 62. Shutting off or reducing the power supplied to the heating element 62 serves to stop of reduce the heating of the element. It will further be understood by those skilled in the art that a control chip included within control system 16 can include algorithms or other software or hardware instructions that controls the supply of electric current for a desired temperature heating.

The control 16 is preferably located on the upper sub assembly 28 and may include a temperature monitoring system 66, a circuit breaker 68, a plurality of mechanical relays 70, a controller 72, a transformer 74, and a display 76. The temperature monitoring system may also include a pair of temperature sensors 78, a plurality of switches 80, and an over temperature switch 82. The temperature sensors 78 may be located on the inlet and outlet portions 32 and 34 of the heating system 14. The temperature sensors 78 are preferably located in the interface fitting 44 of the inlet portion 32 and the second connector 40 of the outlet portion 34 and are adapted to monitor the inlet and outlet temperatures of the water. The switches 80 are mounted to the first connector 38 and the couplers 54 of the heating units. The switches are coupled with the controller 72 and are used to activate the heating elements 62 within the heating tubes 52. The switches may be a Triac switch, although this recitation is not meant to be limiting. The circuit breaker 68 is coupled with the mechanical relays 70 and the controller 72. The transformer 74 supplies power to the mechanical relays 70 and the controller 72. The display 76 shows the user data or information such as the output temperature of the water.

The over temperature switch 82 is located in the second connector 40. The over temperature switch 82 is a safety measure wherein if the temperature at the outlet goes above 140 degrees F. (or some other selected maximum temperature), the control system 16 automatically shuts down the heating system 14. It should be understood that the over temperature switch 82 can be adjusted to shut down the heating system for any range of temperature selected by the user. In the preferred embodiment, the over temperature switch 82 and its associated relay is wired independently from the normal heating operation of the unit such that, even in the even of a malfunction of the heating system, the over temperature switch will detect the rising temperature and shut off the system.

In a preferred embodiment, the control system 16 continually monitors the volume of the water flowing through the unit as well as input and output water temperature. The control system 16 only uses the amount of energy required to heat the water volume that is flowing through the heater to the set temperature. The control system 16 uses a controller loop that monitors the inputs from sensors and continually adjusts the amount of energy that it applies to the heating elements 62 to ensure the correct output temperature. Other than a minor current draw for the control system 16, the water heater 10 also only uses energy when water is flowing through the heater. Hence by not unnecessarily heating water that is to be stored for an indefinite period of time, the tankless water heater system achieves a good degree of energy efficiency. During operation, water flows into the inlet portion 32 and through the flow meter 42. The flow meter 42 measures the flow rate while the temperature sensor 78 measures the temperature of the water. The water then flows through the modular heater 36 and is heated by the heating elements 62 disposed within the heating tubes 52. When the water exits through the outlet portion 34, the temperature sensor 78 measures the temperature of the water. Depending on the temperature of the water the controller may adjust the heating elements 62 within the heating tubes 52 to adjust the temperature of the water accordingly.

The use of a tankless water heater 10 in accordance with the present invention provides a water heater that is more efficient and safer than conventional water heaters. Specifically the water heater 10 uses a lower watt density over a long flow path. Further, a low wattage per inch is used on the heating element 62 thereby reducing the possibility of scale build up and extending the element life. Further, the heating element 62 exhibits a high percentage of heating element surface area to volume of water being heated. In other words the design minimizes the cross-sectional volume of water being heated while maximizing the heating surface of the heating elements.

The water heater 10 is also designed with safety as a key design advantage. Once the water heater 10 is installed, the end user is not exposed to high voltage when removing the main cover of the housing 12. The main cover can be removed to reset the over temperature switch 82 in the event that it has tripped. The unit interrupts both legs of power distributed to the elements at the mechanical relays 70 as well as the circuit breaker 68. The high voltage components are located in the upper subassembly 28 above the wet zone/lower subassembly 30 of the heater 10. However, removing the main cover does not expose the high voltage components.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A tankless water heater for heating water passing therethrough comprising:

a control module;

a heating system controlled by the control module;

wherein the heating system comprises an inlet portion, an outlet portion, and a modular heater interconnected therebetween;

wherein the modular heater comprises a plurality of heating units, each heating unit comprising a heating tube and a coupler, wherein each heating tube defines an interior region and each heating tube includes a helical structure whereby the helical structure imparts a swirling motion on water passing through the interior region of the tube;

a heating element disposed within the interior region of the heating tube;

a controller positioned within the control module;

a first temperature sensor positioned so as to detect water temperature proximate the inlet portion and the first temperature sensor in communication with the controller;

a second temperature sensor positioned so as to detect water temperature proximate the outlet portion, and the second temperature sensor in communication with the controller;

a flow meter positioned so as to measure water flow proximate the inlet portion, and the flow meter in communication with the controller; and wherein the controller controls electrical power applied to each heating element.

2. The tankless water heater according to claim 1 further comprising a display.

3. The tankless water heater according to claim 1 further comprising a switch positioned proximate the coupler and wherein the switch is connected to and controlled by the controller and wherein the switch, upon a signal from the controller, regulates electric current to the heating element.

4. The tankless water heater according to claim 1 further comprising an over temperature switch configured to operate independently of the controller.

5. The tankless water heater according to claim 4 further comprising an over temperature set switch and wherein the over temperature set switch is positioned in the control module.

6. The tankless water heater according to claim 1 further comprising at least one mechanical relay connected to a flow valve for regulating water flow through the system.

7. The tankless water heater according to claim 1 wherein the mechanical relay is positioned within the control module.

* * * * *